United States Patent [19]

Flum

[11] Patent Number: 4,678,088

[45] Date of Patent: Jul. 7, 1987

[54] COLLAPSIBLE DISPLAY AND STORAGE CONTAINER

[75] Inventor: Paul Flum, Ladue, Mo.

[73] Assignee: Paul Flum Ideas, Inc., St. Louis, Mo.

[21] Appl. No.: 856,284

[22] Filed: Apr. 28, 1986

[51] Int. Cl.[4] ..... A47B 47/06

[52] U.S. Cl. ..... 211/73; 211/74; 211/132; 211/194; 211/195

[58] Field of Search ..... 211/72, 74, 73, 126, 211/132, 133, 189, 194, 195; 206/45.31; 220/4 F

[56] References Cited

U.S. PATENT DOCUMENTS

| | | | |
|---|---|---|---|
| 2,924,371 | 2/1960 | Frankenstein | 206/45.31 |
| 3,078,027 | 2/1963 | Keith | 206/45.31 |
| 3,099,357 | 7/1963 | Harris | 211/195 |
| 3,429,428 | 2/1969 | Fowler | 220/4 F |
| 3,834,324 | 9/1974 | Lang | 211/126 |

*Primary Examiner*—Reinaldo P. Machado

*Attorney, Agent, or Firm*—Haverstock, Garrett & Roberts

[57] ABSTRACT

A collapsible display and storage container adaptable for use in modular display units or as an open, free-standing bin, which container is collapsible into a flat package requiring minimum storage and shipping space. The present container device may be constructed from any suitable lightweight material, however, the preferred material of construction is corrugated plastic board.

30 Claims, 12 Drawing Figures

COLLAPSIBLE DISPLAY AND STORAGE CONTAINER

BACKGROUND OF THE INVENTION

The present invention relates to a collapsible display and storage container for use in storing and displaying a wide variety of products packaged and unpackaged including products having varying sizes and shapes and, more particularly, to a foldable board structure adapted to be positioned as an open bin for display and/or storage of both bottled and canned products. The present storage and display container can conveniently be utilized in many display rack applications including the modular display units shown and described in U.S. Pat. No. 3,429,428 and can likewise be utilized in a free-standing configuration for use on flat store counters or other substantially horizontal support structures. Likewise, the storage and display container of the present invention is advantageously collapsible to a flat package which can be stored in a minimum of space and shipped in multiples in relatively small and light packages. Furthermore, the storage and display container of the present invention is produced utilizing relatively light-weight materials of construction while nevertheless being relatively sturdy and reusable.

Recent years have witnessed a growing awareness of the value of utilizing point-of-purchase fixtures and other product display devices and, as a result of this awareness, a variety of display devices, including modular display fixtures, have been designed and manufactured for use in merchandising shelvable products to consumers. These display devices are commonly employed by supermarkets and other retail stores for use in store display windows and other display areas to show and focus attention on the merchandising wares displayed therein. One of the major problems associated with storing and displaying shelvable products for sale to customers is the inefficient use of available shelf space and the inability of the merchant to continuously provide shelvable products which are readily accessible to the customer. Proper utilization of merchandising areas is extremely important to merchants who handle a wide variety of shelvable products, such as numerous bottled and canned goods, since effective use of these areas promotes sales.

Typically, a single modular display unit will contain only one or two sizes of product containers while it often would be advantageous if one or more smaller sized containers of the same or related product were available to the customer on the same display unit or adjacent thereto. Absence of such smaller sized containers of the same or related products in the immediate display area often results in loss of customer interest and possible loss of sales. To require a second modular display unit alongside the first is often not practical due to limitation of aisle or floor space in a particular store or installation. The known devices or methods for storing and merchandising shelvable products have not been able to completely resolve the above problems.

The present collapsible display and storage container solves many of these problems and overcomes many of the disadvantages and shortcomings associated with known display devices, and teaches the construction and use of a relatively simple and economical open display and storage bin convenient and accessible to customers. The collapsible display and storage container of the present invention comprises a flat sheet of board material, preferably a corrugated flexible plastic board material, scored on at least one side to define a center panel, a plurality of foldable side panels, and a plurality of foldable connecting bands joining the outside corners or end portions of successive side panels, each of said connecting bands defining an aperture with each pair of successive side panels and each being scored so as to be bendable or foldable to conform to the posts or other upright members associated with a particular modular display unit. Two of the opposing foldable side panels are foldable onto the top of the center panel while the remaining foldable side panels can be folded on top of the first two side panels or, alternatively, on the bottom of the center panel, thus supplying convenience and economy in shipment and storage of the collapsible container of the present invention.

In use, in conjunction with a modular display unit such as that shown and described in U.S. Pat. No. 3,429,428, the present container device provides a simple and efficient means for effectively displaying individual bottles or cans of shelvable products as well as other products readily accessible to the consumer and at selected or varying heights in a modular display stand. These features are particularly important to merchants because they enhance the accessibility to the customer of any product displayed therein and they more effectively utilize available counter or standing modular display stand floor space. Because of these capabilities, the present device is particularly advantageous for use in supermarkets, convenience stores, grocery outlets, drug and liquor stores, fastfood outlets, and a wide variety of other wholesale and retail stores. Two embodiments of the present collapsible display and storage containers as well as two display arrangements of the present device are disclosed herein, one arrangement of the preferred embodiment adaptable for use with a modular display unit such as that shown and described in U.S. Pat. No. 3,429,428, and the other arrangement being especially adaptable for use as a stand-alone counter, window, or floor container bin. It is anticipated that the present devices can also be utilized in other display unit applications such as refrigerated display coolers and other merchandising systems.

An optional feature of the present device also includes quickly insertable corner brackets which enable the collapsible container of the present invention to be placed in an open angle-sided bin configuration wholly separate and apart from any display module or rack. Thus, the present device is rendered suitable for placing on a counter, wide shelf, store window, or other supporting surface to serve as an open readily accessible bin for dispensing to customers individual sized bottles, cans, or the like of shelvable products. In this open bin configuration, the device of the present invention is also suitable for storage of empty or full containers in storage areas for ready replacement or restocking of empty or partially empty bins in display areas.

It is therefor a principal object of the present invention to provide an efficient and attractive product display container adaptable for display and storage of a wide variety of shelvable products therein.

Another object is to provide a display and storage container which is relatively simple and inexpensive.

Another object of the present invention is to provide a display and storage container which is collapsible to a flat folded configuration for ease of shipment and storage.

Another object of the present invention is to provide a display and storage container which is constructed of relatively lightweight materials.

Another object of the present invention is to provide a display and storage container which is sturdy and able to withstand normal usage.

Another object of the present invention is to provide a display and storage container which is reusable.

Another object of the present invention is to provide a display and storage container which is quickly and efficiently adapted for use separate and apart from other display units or modules.

Another object of the present invention is to provide a display and storage container specially adapted for use in combination with standard modular display units.

Another object of the present invention is to provide a display and storage container which can be quickly and easily installed into a standard modular display unit.

Still another object of the present invention is to provide a display and storage container adapted for use as a separate collecting or storage bin.

These and other objects and advantages of the present invention will be apparent to those skilled in the art after considering the following detailed specification in conjunction with the accompanying drawings, wherein.

Figure 1:
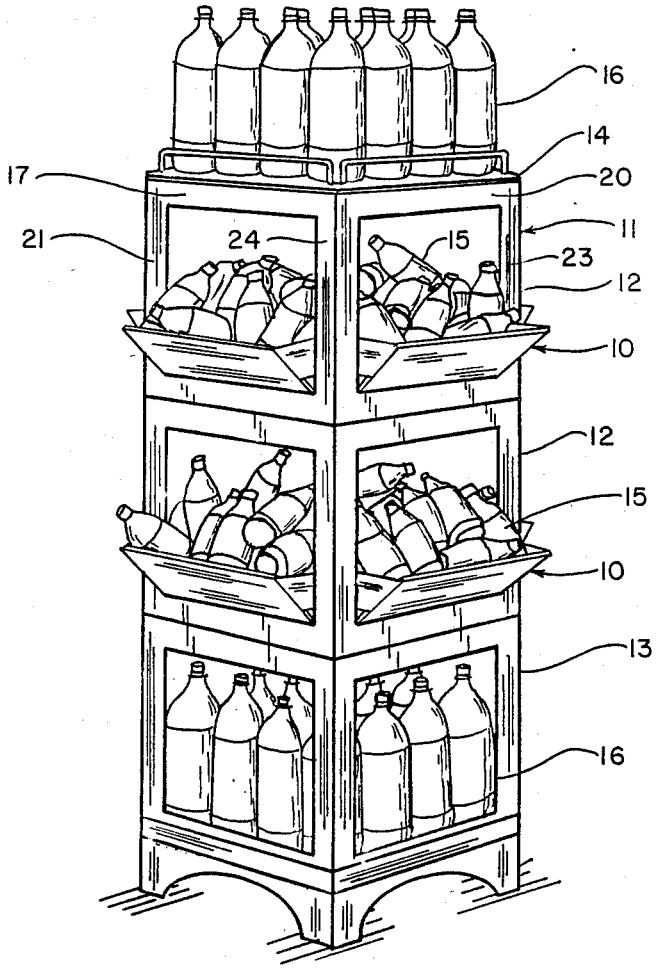
FIG. 1 is a perspective view of one embodiment of the present invention illustrating use of the present devices in a modular display unit.

Referring to the drawing more particularly by reference numbers wherein like numerals refer to like parts, number 10 in FIG. 1 identifies one embodiment of the present collapsible display and storage container in conjunction with a modular display stand 11 which includes units 12 and 13 that are conveniently adaptable for stacking in a column as shown in FIG. 1. The units 12 carry the display and storage containers 10 of the present invention, which containers are shown filled with the smaller sized bottled soft drink products 15 such as 16 oz. bottled products, while the unit 13 and the top shelf 14 of the modular display stand 11 are shown holding larger volume bottled soft drink products 16 such as 2 and 3 liter bottled products. Such modular display units as shown in FIG. 1 can be assembled in stand-alone columns for the merchandising of a wide variety of products and such units are described in U.S. Pat. No. 3,429,428. Each unit of the modular display stand 11 is formed of a plurality of similar side wall panels such as the panels 17 and 20 (FIG. 1) which innerlock in such a way as to form corner posts 21, 22, 23, and 24 (FIGS. 1 and 6) with recessed interconnections. Vertical alignment of the stacked modules 12 and 13 is achieved by cooperative engagement between upwardly extending projections (not shown) on the panel upper flanges and corresponding recesses (not shown) formed in the lower flanges. These modular display units are commonly utilized in supermarkets and other convenience stores and are used for merchandising a wide variety of shelvable products, particularly, bottled and canned soft drinks and other beverages. Although the present collapsible display and storage containers 10 are primarily designed for use with each of the modular display units within the display stand 11 such as the modular units 12, they can likewise be easily adaptable for use with other types of display apparatus and merchandising systems as well.

Figure 2:
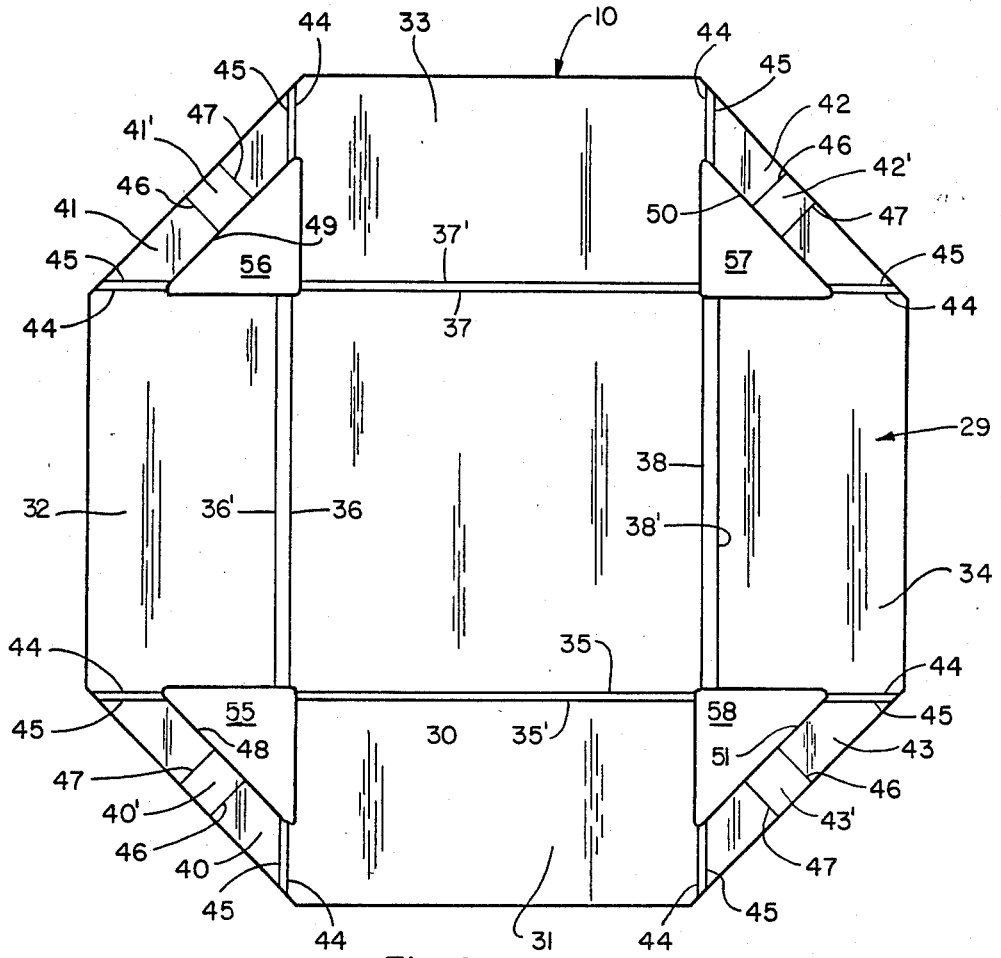
FIG. 2 is a top plan view of one of the present devices of FIG. 1.

Referring to FIG. 2, the collapsible display and storage container 10 is shown in its initial flat form as a generally octagonal shaped sheet 29 of a board type material scored on at least one side to define a center panel 30 and at least four foldable side panels 31, 32, 33, and 34 defined by score lines 35, 35', 36, 36', 37, 37', 38, and 38' respectively. The sheet 29 also is shown to contain at least four connecting bands 40, 41, 42 and 43 joining the outer corners or end portions of the successive side panels 31–34, each connecting band being scored for flexibility at the juncture with the outer corners of each successive side panel by pairs of adjacent score lines 44 and 45 and each being additionally scored about respective central segments 40', 41', 42' and 43' by spaced apart score lines 46 and 47. Together with the sides of the respective successive side panels 31 and 32, 32 and 33, 33 and 34, and 34 and 31, the respective connecting bands 40, 41, 42, and 43 define with their inner sides 48, 49, 50, and 51 cut-out apertures 55, 56, 57, and 58, which apertures provide flexibility for both the side panels and the connecting bands without bending or deforming the structural portions of the respective side panels and connecting bands defined by the above-described score lines.

Although the initial flat form of the subject collapsible display and storage container 10 has been shown (FIGS. 2 and 7) and described as an octagon-shaped sheet 29 having a substantially square center panel 30, the present invention is not limited to such described shape. Thus, in order to be accommodated by display rack units of varied plan design, collapsible containers 10 of board type sheets 29 can be produced in a variety of shapes with attendant variations in both the number and size of the side panels 31–34, the connecting bands 40–43 and the defined apertures 55–58. Thus, there can conveniently be produced many sizes of basically rectangular shaped sheets 29 with wide variation in the longitudinal and lateral dimensions thereof having the same basic numbers of four successive side panels joined by four connecting bands together defining four cut-out apertures of varying shape. Likewise, in order to accommodate modular display units of circular design, a flat sheet of board type material can be produced with a circular center panel 30 having any number of successive side panels similar to the side panels 31–34, and a corresponding number of connecting bands similar to the bands 40–43, all of such side panels and connecting bands being defined in a similar manner by score lines as described above in connection with the score lines 35–38, 35'–38' and 44–47, but such score lines being in greater or lesser numbers and running in possibly different directions. Therefore, it will be appreciated by those skilled in the art that the present display and storage containers can be produced in a wide variety of shapes suited and adaptable to an equally wide variety of modular display units.

Figure 6:
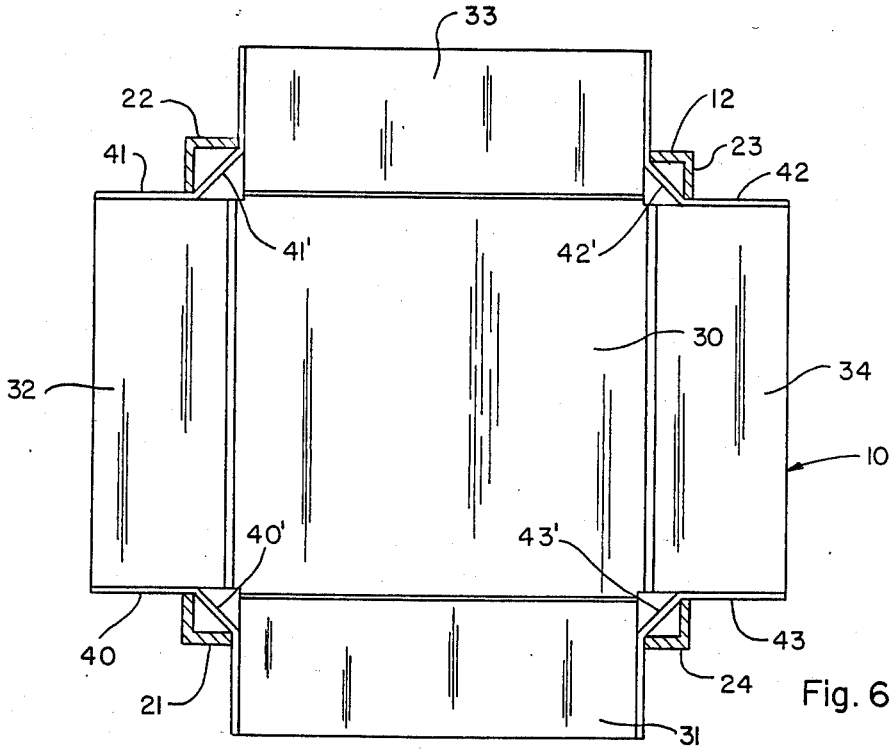
FIG. 6 is a top plan view of one of the present devices of FIG. 1 shown in place in a modular display unit.

The use of the present collapsible display and storage container, the flat form of which is shown in FIG. 2, is illustrated in FIG. 6 to which reference should be made. FIG. 6 shows the present collapsible container 10 in plan view when mounted in a module 12 of the modular display stand 11. The single modular unit 12 as above-described has four corner posts 21, 22, 23, and 24 shown in plan section in FIG. 6. The collapsible container 10 is folded and inserted into the modular unit 12 so that the center panel 30 rest upon the floor portion (not shown) associated with each module. Upon insertion of the present container 10 within a particular module, the connecting bands 40–43 respectively engage the modular unit corner posts 21–24 at the central segments 40'–43' thereof between the above described pairs of spaced apart score lines 46 and 47. The thus engaged connecting bands 40–43 serve to firmly hold the present container 10 in position with the folded side panels 31–34 in partially upright position and define with said side panels an open bin in the modular unit 12 as more fully illustrated in FIG. 1. This provides a readily accessible open bin container from which customers can easily access the products displayed therewithin such as the soft drink products 15 shown in FIG. 1 and it likewise facilitates restocking by store employees. Thus, when used in conjunction with the modular unit 12, the collapsible display and storage container 10 of the present invention provides an efficient, adaptable, reusable, and accessible container admirably suited for merchandising purposes.

Figure 3:
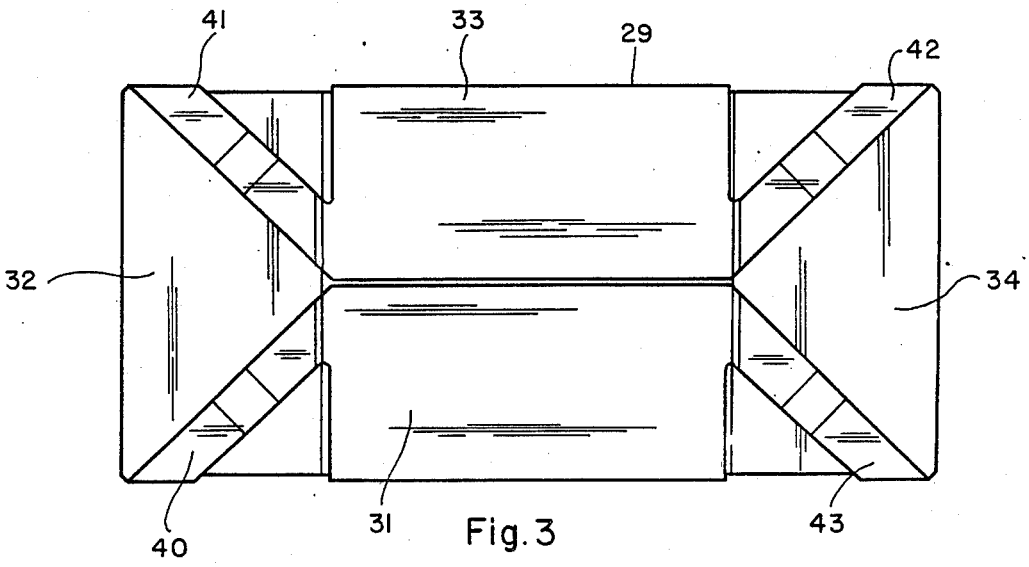
FIG. 3 is a top plan view of one of the present devices of FIG. 1 shown in a partially folded condition.
Figure 5:
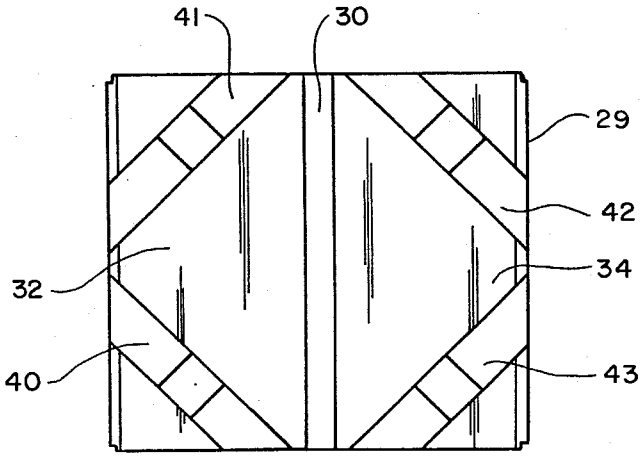
FIG. 5 is a bottom plan view of one of the present devices of FIG. 1 shown in fully reverse folded condition.
Figure 4:
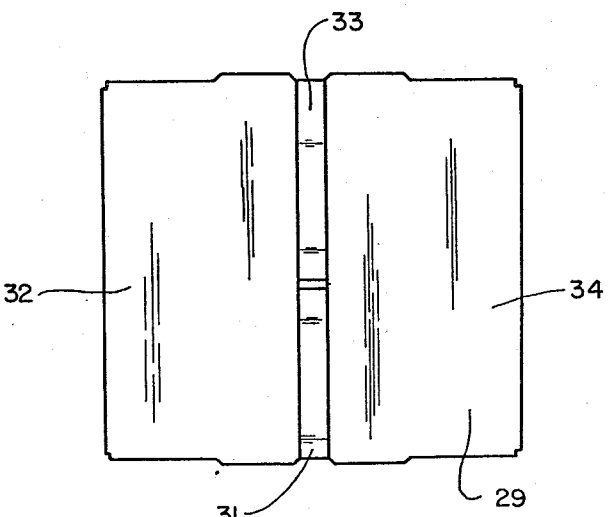
FIG. 4 is a top plan view of one of the present devices of FIG. 1 shown in a fully folded condition.

Reference to FIGS. 3–5 will serve to illustrate the ease and facility with which the collapsible container of the present invention can be folded for economical and facile shipment and/or storage. In FIG. 3 there is shown a plan view of the flat sheet 29 of FIG. 2 with two opposing side panels 31 and 33 folded in on top of the center panel 30 (not shown in FIG. 3) with their respective connecting bands 40–43 folded over the two remaining side panels 32 and 34. The folding of the side panels 31 and 33 is facilitated by the paired score lines 35 and 35', 37 and 37', 44 and 45, as above-described. FIG. 4 shows the remaining side panels 32 and 34 folded over the first pair of side panels 31 and 33 to produce a substantially flat, three layer package of the approximate dimensions of center panel 30. Likewise, in FIG. 5 there is illustrated an alternative packing and storage configuration in which the remaining two side panels 32 and 34 with their associated connecting bands 40–43 are reverse folded beneath the center panel 30 to again form a flat, three layer package of the approximate dimensions of the center panel 30. The upward and the reverse folding of the second pair of side panels 32 and 34 are both facilitated by the double fold lines produced by the somewhat wider spacing of score lines 36, 36' and 38, 38' as shown in FIG. 2. It will be apparent that the resulting folded packages of the sheets 29 will require substantially less floor, shelf, or wall space for storage and such sheets can be packaged in multiple numbers in packages or cartons of substantially more easily handled sizes than could the initial unfolded, flat sheets 29. The above described ability to be folded into a flat configuration of relatively smaller dimensions affords the above-described facility in both packaging for shipment and storage of the present collapsible containers and this adds substantially to the attractiveness of the present containers 10 to display merchandisers and store managers.

Figure 8:
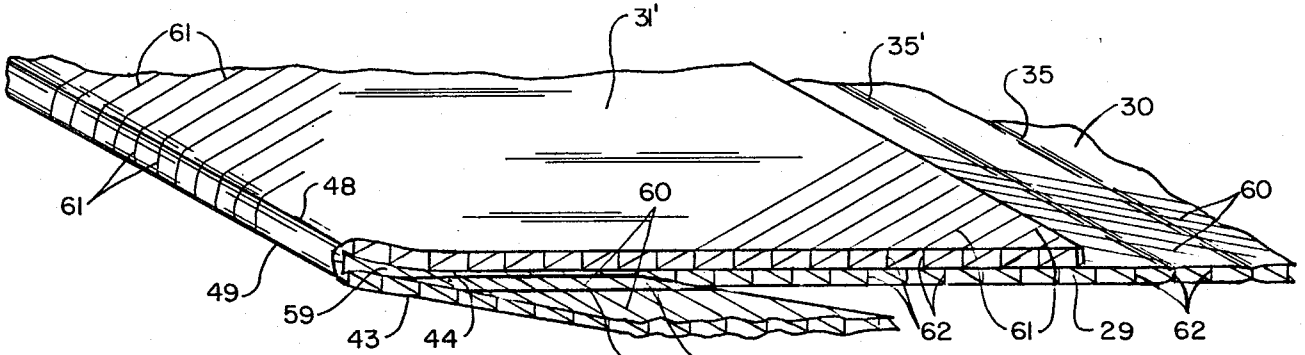
FIG. 8 is a partical cross-sectional perspective view of the device of FIG. 7 taken along the line 8—8 of FIG. 7.
Figure 7:
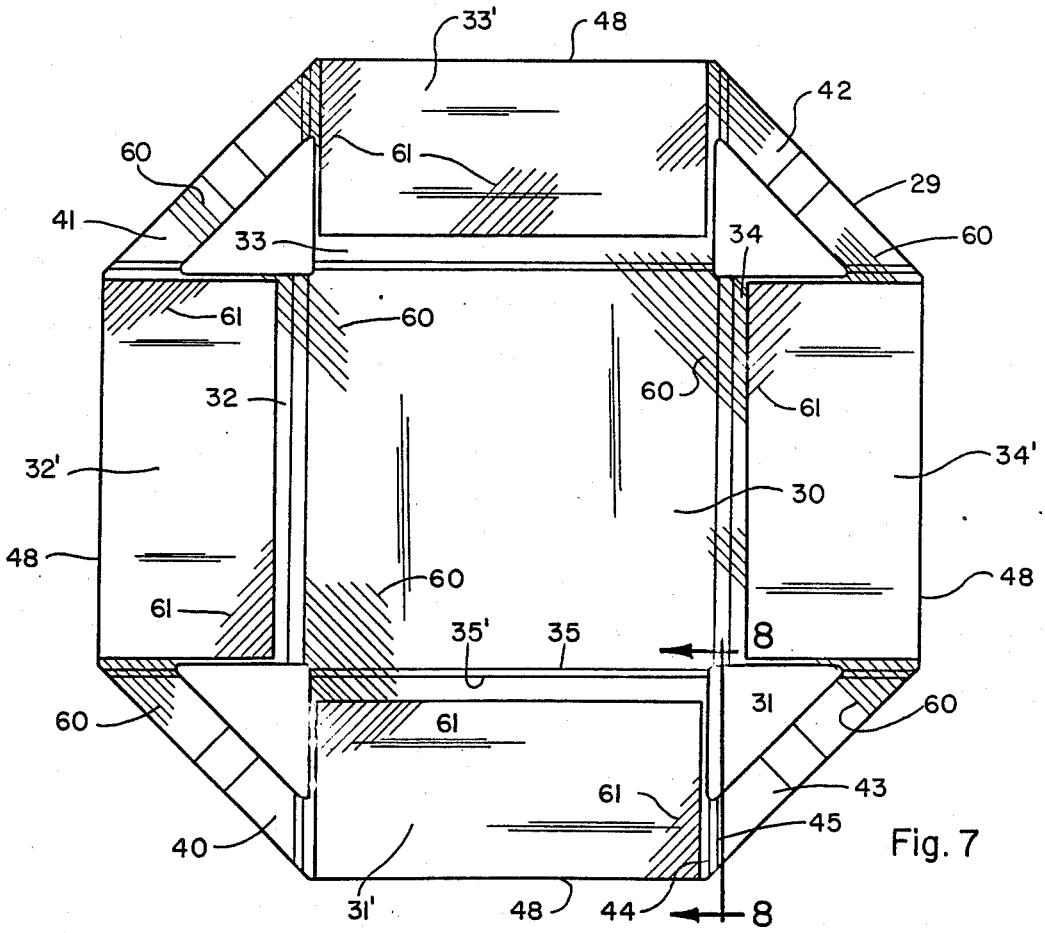
FIG. 7 is a top plan view of a preferred embodiment of the present device.

A second and more preferred embodiment of the present invention is illustrated in FIGS. 7 and 8, wherein FIG. 7 shows a plan view of the initial flat finished sheet 29 and FIG. 8 shows a partial perspective view of side panel 31 and 31' together with portions of connecting band 43 and center panel 30 taken along the line 8—8 of FIG. 7. In FIG. 7 it is shown that side panels 31–34 are intially formed with additional extension panels 31', 32', 33', and 34' of substantially the same dimensions as the initial dimensions of side panels 31–34. The extension panels 31'–34' are folded over the respective side panels 31–34 and the mating surfaces thereof bonded together by means of adhesives or heat sealing or use of mechanical fasteners over a substantial majority of the mating surfaces while leaving unbonded those portions of the mating surfaces adjacent the outer folded portion of the mated side panels. The folding and bonding of the respective extension panels 31'–34' to the side panels 31–34 is facilitated by the provision of paired score lines 48 and 49 serving to define the extension panels 31'–34' from the side panels 31–34. Such paired score lines 48 and 49 essentially replicate paired score lines 35, 35' and 37, 37' of FIG. 2.

The resulting double thickness side panel 31, 31' is shown in partial perspective in FIG. 8. In FIG. 8 it will be seen that the same unitary board sheet 29 is initially shaped by cutting and scoring to define the extension panels 31'–34' as integral extensions of side panels 31–34 and thereafter each respective extension panel is folded over its corresponding side panel and bonded thereto. For example, the extension panel 31' is folded over side panel 31 and bonded to panel 31 over substantially the majority of the mating surfaces of said extension and side panels 31' and 31. There is left unbonded the space defined by the respective folded but not fully mating surfaces of extension panel 31' and side panel 31 as shown at 59 of FIG. 8. The thus produced open space 59 associated with each folded over side panel can be utilized in a later described configuration of the present container when intended for stand-alone set up and is thus a preferred embodiment of the collapsible display and storage container of the present invention.

Although the present container 10 can be fabricated from any suitable lightweight board type material, it is preferred that the board type material be corrugated and, more particularly, it is preferred that the material of construction be a corrugated plastic board material as will be hereinafter explained. Corrugated boards are constructed of various materials, which materials offer various degrees of stability, strength, and resistance to wear and damage in use. All such corrugated boards are produced so as to have two relatively smooth outer surfaces and an interior composed of corrugated, fluted or substantially vertical walls with a high predominance of open space between the outer sheets of material forming the upper and lower surfaces thereof. In the long known corrugated paper board, the interior is formed of a fluted sheet of paper material bonded at the peaks of the flute to the outer surface sheets of paper. In the more recently available corrugated plastic board which may be produced by extrusion of molten plastic through dies, there is produced an interior of substantially vertical walls of the plastic material integral at the upper and lower edges with the substantially flat upper and lower continuous sheets of the plastic material which form the upper and lower surfaces of the board. As a result of the process of manufacture of such corrugated plastic board the upper and lower surfaces thereof display alternating ridges and valleys, the valleys indicated in FIGS. 7 and 8 by reference numerals 60 and 61. The above-described valleys coincide with the upper and lower edges of the vertical walls forming the corrugations on the interior of the corrugated plastic board as a result of its method of manufacture and thus serve as a surface indication of the direction, frequency and spacing of the interior vertical walls 62, as can be most clearly seen in FIG. 8. It is the frequency and spacing of these interior walls 62 that confer on the corrugated plastic board its stength and stiffness.

In the collapsible display and storage container of the present invention it is advantageous to provide added strength and stiffness to the structure by utilizing this feature of the corrugated plastic board sheets from which the structure is produced. This advantage is realized by cutting the corrugated plastic board sheet so as to produce the initial desired shape in such a manner that the corrugations, i.e., the interior vertical walls 62 forming the corrugations, lie at an acute angle to the longitudinal axis of the sheet thus produced. It will be appreciated by those skilled in the art that a structure formed from a corrugated board will demonstrate its greatest stiffness and strength in both a longitudinal and lateral direction when the corrugations of the corrugated board lie at an angle to such axes. It will further be appreciated by those skilled in the art that when double thickness panels of corrugated board are formed by bonding two thicknesses of such corrugated board together, the greatest stiffness and structural strength will be produced by providing that the corrugations of the respective thicknesses of corrugated board lie in intersecting, and preferably, opposite directions. These advantages of such an arrangement are illustrated in FIGS. 7 and 8.

As above discussed, it has been found advantageous in the collapsible display and storage container 10 of the present invention to provide that such corrugations lie at an acute angle to the longitudinal axis of such container when in flat, originally-produced condition. Thus, it has been found advantageous that the corrugations of the corrugated board sheet lie at an acute angle of greater than 20° to the longitudinal axis thereof, more preferably at an acute angle of from about 30° to about 60°, and even more preferably at an angle of about 45° to such longitudinal axis. This most preferred form of the present container 10 is illustrated in FIGS. 7 and 8 wherein it may be seen that vertical walls 62 and the coincident surface valleys 60 and 61 lie at approximately a 45° angle to the longitudinal axis of the container. It will further be seen that as a result of the folding and bonding of extension panels 31'–34' to side panels 31–34, the corrugations in the respective bonded panels lie at opposite and complementary 45° angles to the longitudinal axis of the present container. As mentioned above, this will afford the greatest stiffness and structural strength to the double layered side panels produced by the folding and bonding of the respective extension panels to their corresponding side panels as fully illustrated in FIGS. 7 and 8.

Figures 9, 10, 11:
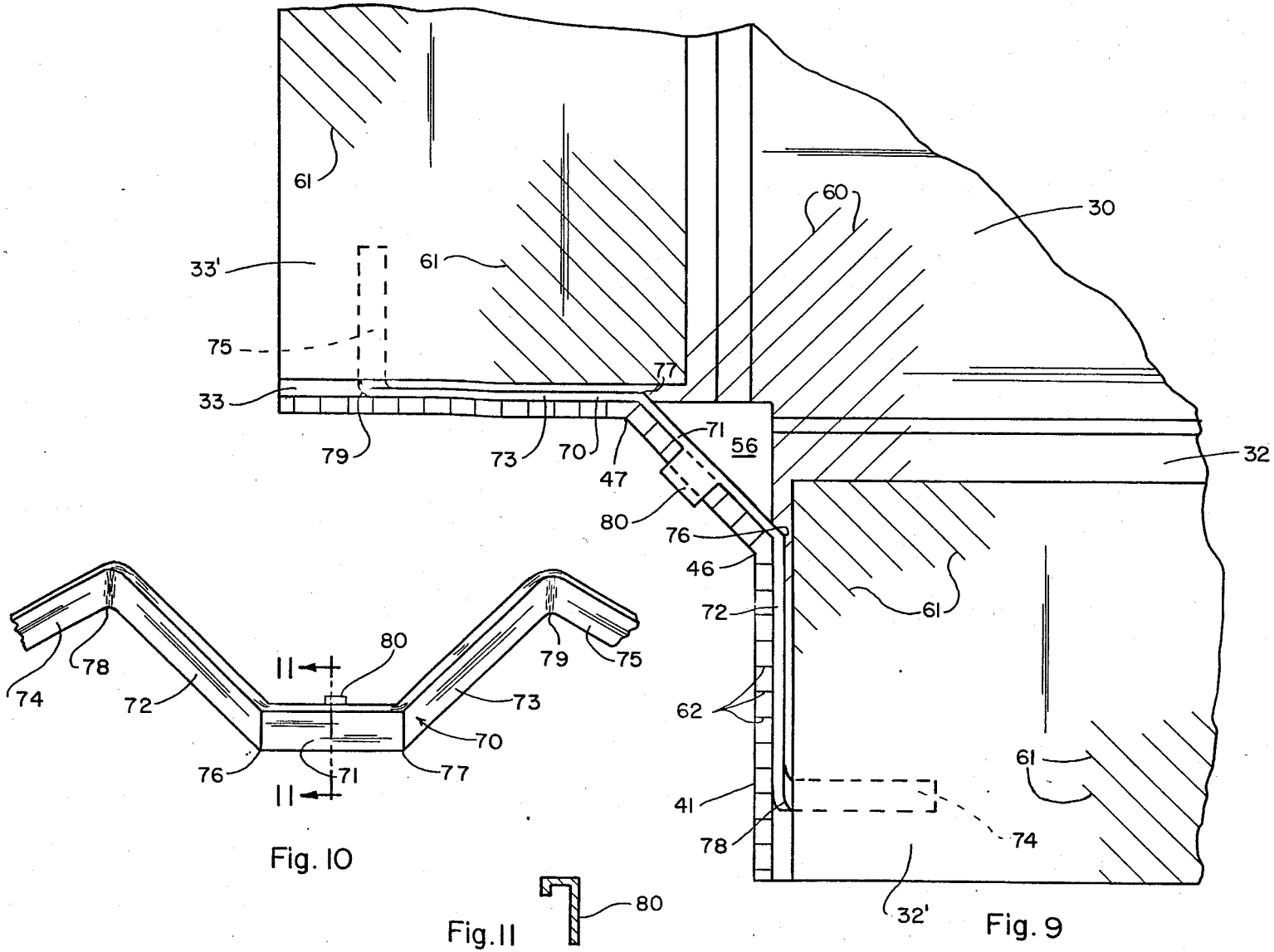
FIG. 9 is a partial plan view of the embodiment of FIG. 7 in open bin configuration.
FIG. 10 is a partial perspective view of the corner bracket shown in place in FIG. 9.
FIG. 11 is a cross-sectional view taken along line 11—11 of FIG. 10.

FIGS. 9 and 10 illustrate an alternative configuration of the collapsible display and storage container of the present invention for use as an open, free-standing display or storage container suitable for placing on counters, open shelves, in store windows, or other convenient forms of base support. FIG. 9 is a partial plan view of the corner of the subject container defined by side panels 32 and 33 of doubled construction having extension panels 32' and 33' folded over and bonded to the upper surfaces of side panels 32 and 33 respectively. FIG. 10 is a partial perspective view of a corner bracket 70 which is shown as a bar of five straight segments 71–75. Corner bracket 70 may be constructed of any convenient bar stock such as metal or plastic, preferably plastic bar stock. To provide corner bracket 70 the originally straight bar stock is bent, molded or formed so as to produce a center straight segment 71, straight segments 72 and 73 joined to the respective ends of straight segment 71 and each diverging therefrom at an angle of approximate 135°, and straight segments 74 and 75 each rspectively joined to the respective end of segments 72 and 73 and each diverging therefrom at an angle of approximately 90°, each of the segments 74 and 75 being rotatably formed to an acute angle of from about 35° to about 45° away from the plane of the center segment 71. As will readily be appreciated, the corner bracket 70 is used to position and stabilize the side panels such as the panels 32 and 33 at an angle of approximately 45° to the plane of the center panel 30 such as by inserting the end segment 74 into the unbonded space 59 (FIG. 8) formed at the folded edge of side panel 32 with bonded extension panel 32' and likewise inserting end segment 75 into the corresponding unbonded space 59 formed between side panel 33 and folded extension panel 33'. Similar corner brackets 70 are positioned at the remaining three corners of the present container by inserting such brackets 70 into the unbonded spaces 59 associated with the remaining side and extension panels. The result obtained will be seen to be an open display and storage container with side panels 31–34 stably positioned at approximately 45° angles from the floor panel 30 of said container and with connecting bands 40–43 defining the corners of said container. Score lines 46 and 47 in connecting bands 40–43 enable said connecting bands to conform to the fixed shape of corner brackets 70 when those corner brackets are inserted into the open spaces 59 of the respective side panels 31–34. In this regard, it is also recognized that optional hook or other attachment means such as the hook means 80 shown in FIGS. 9–11 may be associated with the brackets 70 for engaging and holding the respective connecting bands 40–43 in conforming relationship with said brackets. In the example illustrated in FIG. 10, the hook means 80 may be integrally formed with or attached to the center segment 71 of each bracket 70 so as to overlap and engage the respective central segments 40'–43' associated with the connecting bands 40–43. It is also recognized that any other suitable hook or attachment means may likewise be utilized to hold the connecting bands 40–43 in conforming relationship with the corner brackets 70.

Thus, there has been described and illustrated in FIGS. 9 and 10 an attractive and alternative configuration for the preferred form of the collapsible display and storage container of the present invention which has been found to be extremely useful and attractive to merchandisers generally. This alternative configuration affords opportunities for display and merchandising of bottled, canned, and/or packaged and unpackaged products in an open free-standing and readily accessible container which can be positioned at any convenient location in a store. This configuration also finds utility in warehousing and storage areas as a ready collection bin for empty containers such as beverage cans or bottles. Many other uses of such an open and accessible free-standing container will occur to those versed in convenience and grocery store merchandising. It is also recognized that a band or strap (not shown) may likewise be positioned around and attached to the outer portion of the side panels 31–34 by any suitable conventional means for angularly stably positioning the side panels 31–34 relative to the floor panel 30. This will likewise produce an open free-standing container which can be positioned anywhere for use.

It should also be noted that although the use of the apertures 55–58 is generally preferred because these apertures or openings greatly facilitate folding of the side panels 31–34 and connecting bands 40–43 when forming the sheet 29 into its open bin configuration, it is also recognized that the present containers 10 can be formed by using sheets of board material which do not include an opening or aperture between adjacent side panels and the connecting band or panel extending therebetween. In this situation, the connecting panel positioned between and joining the respective adjacent side panels of the container must be easily foldable so as to conform to the corner posts or other positioning and stabilizing means about which said connecting panels must be maneuvered and positioned. This construction will work equally as well where the sheet of board material is relatively thin so that excessive crimping and bunching of the material does not occur around the positioning and stabilizing means, namely, the corner posts. As the thickness of the material increases, more difficulty may be encountered in folding the connecting panels to conform with the corner posts or other stabilizing means.

Figure 12:
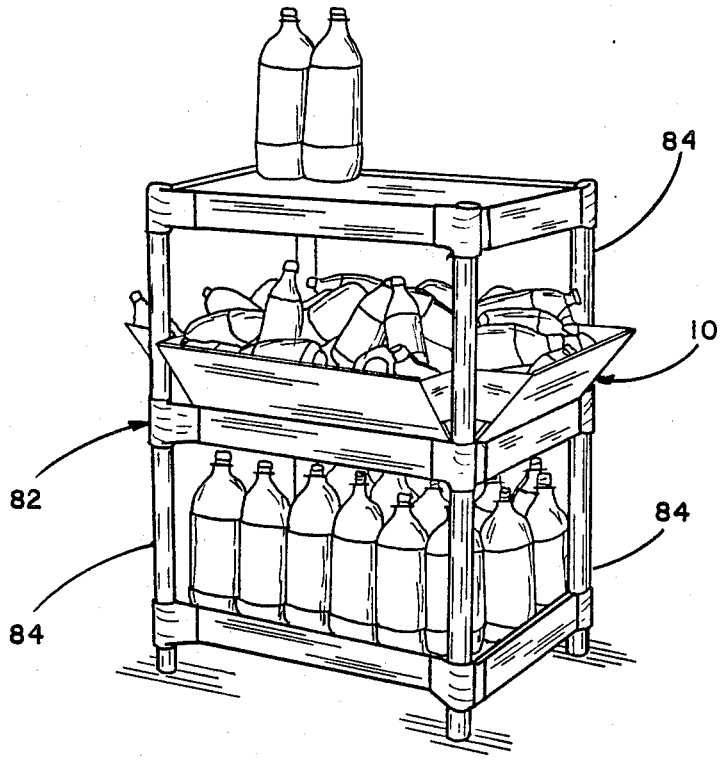
FIG. 12 is a perspective view similar to FIG. 1 illustrating use of the present device in a differently styled modular display unit.

FIG. 12 illustrates use of the present container 10 in a differently styled modular display unit 82 wherein round or circular corner posts 84 are utilized instead of the L-shaped posts 21–24 illustrated in FIGS. 1 and 6 with respect to the modular display stand 11. As can be seen, the present container 10 is easily adaptable for use in a wide variety of display stand applications regardless of the shape or size of the positioning and stabilizing means, namely, the corner posts, associated respectively therewith.

Materials of construction suitable for use in forming the collapsible display and storage containers of the present invention comprise any of the known types of both corrugated and uncorrugated board material, although a corrugated board material is preferred as explained above. In this regard, the standard corrugated paperboard of commerce, generally employed for cardboard carton construction, can be used to produce the present containers, but that material does not afford either resistance to wetting or adaptability to repeated reuse, both of which properties are desired in the present containers. Therefore, the preferred material of construction for the containers of the present invention is corrugated plastic board which has become available in recent years as a standard commercial item. Such suitable corrugated plastic board may be made from any polymers which when extruded or bonded as corrugated board demonstrate the requisite flexibility for folding and collapsing along score lines and the needed strength and stiffness as well as the desired properties of resistance to wetting, washability and adaptation to reasonable reuse. Among polymers suitable for producing such corrugated plastic board are the polyolefins, such as polyethylene and polypropylene and copolymers of polyethylene and polypropylene, polyvinylchoride, polyesters, such as polyethylene terephthalate and polyamide such as nylon 6 or nylon 66. The polymer composition which has been found most suitable for the corrugated plastic board employed in the collapsible display and storage containers of the present invention is a copolymer of polyethylene and polypropylene. Corrugated plastic board of such copolymer compositions are standard items of commerce and can be obtained from a variety of sources. One such brand of suitable corrugated plastic board is Primex Cor-X board available from Primex Plastics Corporation of Richmond, Indiana. Other producers of suitable corrugated plastic board will be known to those skilled in the art.

The corrugated plastic board used in the collapsible display and storage containers of the present invention can be shaped as desired by scoring and cutting by means of well-known methods employing equally well-known apparatus and machinery, both of which are familiar to those skilled in the corrugated board art. One such suitable means of shaping and scoring the corrugated board comprises pressing such board against suitable cutting and scoring dies positioned on one side of the board. The corrugated board can also be shaped by utilizing thermal or heated die cutting and scoring processes. Production of the corrugated board with corrugations lying at any desired angle to the longitudinal axis of such desired shape can be readily achieved by plan positioning of the starting corrugated board blanks, as will be appreciated by those skilled in the corrugated board art.

Thus, there has been shown and described several embodiments of a novel collapsible display and storage container admirably suited for use in standard merchandising display units or as free-standing open type containers for use in merchandising and storing shelvable products, which containers fulfill the objects and advantages sought therefore. Many changes, modifications, variations and other uses and applications of the collapsible display and storage containers of the present invention will, however, become apparent to those skilled in the art after considering this specification and the accompanying drawings. All of such changes, modifications, variations and other uses and applications which do not depart from the spirit and scope of the invention described herein are deemed to be covered by the invention which is limited only by the claims which follow.

What is claimed is:

1. A collapsible display container comprising a sheet of material having top and bottom surfaces and a plurality of side edges, said sheet including means for weakening said sheet along a portion thereof, said weakening means being positioned at an intermediate location spaced from said plurality of side edges and defining a central panel portion within said sheet, portions of said sheet located between said weakening means and said plurality of side edges defining a plurality of side panels, each of said side panels being movable about said weakening means in at least one direction relative to said central panel portion, and a plurality of connecting panels each positioned respectively between and joining adjacent side panels, each of said connecting panels having at least a portion thereof movable to a position out of the planes of said side panels and in a direction towards said central panel portion.

2. The collapsible display container of claim 1 wherein said sheet of material includes corrugations.

3. The collapsible display container of claim 2 wherein said sheet of material is a corrugated sheet having its corrugations oriented at an angle relative to the weakening means formed between the central panel portion and selected ones of said side panels.

4. The collapsible display container of claim 1 wherein said container is positioned within a support structure, said support structure including a plurality of substantially upright members, each of the connecting panels of said container being movable so as to conform respectively to the substantially upright members of said support structure.

5. The collapsible display container of claim 1 wherein said sheet of material is comprised of a flexible material.

6. The collapsible display container of claim 1 wherein said sheet of material is comprised of a rigid material.

7. The collapsible display container of claim 1 wherein said sheet of material is formed into a bin by moving said side panels to positions angularly related to said central panel portion and positioning corner fastening means respectively between each pair of adjacent side panels for holding said side panels in angular relationship relative to said central panel portion.

8. The collapsible display container of claim 7 wherein said corner fastening means include means for engaging a respective connecting panel.

9. The collapsible display container of claim 7 wherein said corner fastening means include means for engaging a respective pair of adjacent side panels.

10. A collapsible display container comprising a sheet of corrugated board scored on at least one side to define a rectangular center panel, at least four foldable side panels attached to said center panel, each of said side panels having opposed end portions, and at least four foldable connecting bands, each of said connecting bands being attached to and joining the adjacent end portions of successive side panels, each pair of successive side panels and said connecting band attached therebetween defining an opening, each of said connecting bands being scored so as to conform to positioning and stabilizing means, said sheet of corrugated board being formed into a bin by folding in said side panels and inserting said folded sheet into an open-sided box-shaped storage module, said box-shaped module including positioning and stabilizing means in the form of corner posts, and thereafter folding out said side panels until said connecting bands engage the corner posts of said box-shaped module.

11. The collapsible display container of claim 10 wherein said openings defined by said connecting bands and said successive side panels are triangular in shape.

12. The collapsible display container of claim 10 wherein the corrugations associated with said sheet of corrugated board lie at an angle of at least 20° to the longitudinal axis of said sheet.

13. The collapsible display container of claim 10 wherein the corrugations associated with said sheet of corrugated board lie at an angle in the range from about 50° to about 60° to the longitudinal axis of said sheet.

14. The collapsible display container of claim 10 wherein the corrugations associated with said sheet of corrugated board lie at an angle of substantially 45° to the longitudinal axis of said sheet.

15. The collapsible display container of claim 10 wherein said sheet of corrugated board is scored so that a first pair of opposing side panels can be folded over said center panel.

16. The collapsible display container of claim 15 wherein said sheet of corrugated board is scored so that the remaining opposing side panels can be folded over said first pair of side panels.

17. The collapsible display container of claim 15 wherein said sheet of corrugated board is scored so that the remaining opposing side panels can be reverse folded beneath said center panel.

18. The collapsible display container of claim 10 wherein said side panels comprise a double thickness of said corrugated board folded flat and bonded over a substantial portion of the mating surfaces.

19. The collapsible display container of claim 10 wherein said sheet of corrugated board is comprised of a flexible plastic.

20. The collapsible display container of claim 10 wherein said sheet of corrugated board is comprised of a flexible polyolefin homopolymer or copolymer.

21. The collapsible display container of claim 10 wherein said sheet of corrugated board is comprised of a flexible copolymer of polyethylene and polypropylene.

22. The collapsible display container of claim 18 wherein said sheet of corrugated board is formed into a bin by folding up said side panels and inserting an angled corner bracket into the top folds of each pair of successive side panels.

23. The collapsible display container of claim 22 wherein the corner bracket adapted to form said sheet of corrugated board into a bin comprises an angled bar having a first straight center segment, two second straight angled segments in a plane at an obtuse angle to said center segment, and two straight end segments lying in a plane at a right angle to said second segments, said end segments being rotated rearwardly at an angle of about 35° to 45° from vertical and projecting away from said first and second segments.

24. A display container for use in combination with a modular display unit having a plurality of similarly connected side wall panels, said display container comprising a flat sheet of corrugated board scored on at least one side to define a center panel, a plurality of foldable side panels, a plurality of foldable connecting bands, each of said connecting bands joining adjacent side panels and defining with each pair of said adjacent side panels an opening, each of said connecting bands being scored so as to conform to positioning and stabilizing means associated with said modular display unit, said positioning and stabilizing means including the corner posts formed by the adjacent abutting side wall panels of said modular display unit.

25. A display container for use in combination with a support structure having a plurality of substantially upright support means, said display container comprising floor means having a plurality of side edges, a plurality of side portions, means for attaching said side portions to the side edges of said floor means, a plurality of connecting portions, each of said connecting portions joining adjacent side portions, each of said connecting portions being movable so as to conform to the substantially upright support means associated with said support structure.

26. A display container for use in combination with a support structure having a floor portion and a plurality of substantially vertical support means, said display container comprising a plurality of side panels positioned adjacent to the floor portion of said support structure, a plurality of connecting panels, each of said connecting panels joining adjacent side panels and each being foldable so as to conform to the substantially vertical support means associated with said support structure.

27. A display container for use in combination with a support structure having a floor portion and a plurality of substantially vertical support means, said display container comprising a plurality of side portions positioned adjacent to the floor portion of said support structure, said side portions being angularly related to the floor portion of said support structure, and means for attaching said side portions to the substantially vertical support means associated with said support structure.

28. A display container comprising floor means, a plurality of side portions attached to said floor means, said side portions being movable in at least one direction relative to said floor means, and a plurality of connecting portions each positioned respectively between and joining adjacent side portions, each of said connecting portions having at least a portion thereof movable to a position out of the planes of said side portions and in a direction towards said floor means.

29. A display container for use in combination with a support structure having floor means and a plurality of substantially vertical support means, said display container comprising a plurality of wall members positioned in angular relationship adjacent to the floor means of said support structure, each of said wall members having opposed end portions and each being positioned between a pair of adjacent support means, and means associated with each end portion of said wall members for engaging a respective one of said substantially vertical support means for maintaining said wall members in angular relationship with the floor means of said support structure.

30. The display container of claim 29 wherein said means associated with each end portion of said wall members includes a connecting portion positioned respectively between adjacent wall members, each of said connecting portions having at least a portion thereof movable to a position out of the planes of said wall members and in a direction towards the floor means of said support structure.

* * * * *